United States Patent [19]

Edmunds, Jr.

[11] 4,094,122

[45] June 13, 1978

[54] APPARATUS FOR HANDLING EXTRUDABLE SUBSTANCES

[76] Inventor: Raymond S. Edmunds, Jr., 817 Eventide Dr., San Antonio, Tex. 78209

[21] Appl. No.: 803,050

[22] Filed: Jun. 3, 1977

[51] Int. Cl.[2] ..... B65B 63/00

[52] U.S. Cl. ..... 53/23; 53/32; 53/52; 53/123; 53/209; 53/389

[58] Field of Search ..... 53/23, 32, 122, 123, 53/52, 209, 389; 426/414, 420

[56] References Cited

U.S. PATENT DOCUMENTS

| | | | |
|---|---|---|---|
| 3,019,578 | 2/1962 | Cohen | 53/123 |
| 3,020,687 | 2/1962 | Joa | 53/23 |
| 3,345,795 | 10/1967 | Anderson | 53/23 |
| 3,445,983 | 5/1969 | Stevens | 53/52 |

*Primary Examiner*—Othell M. Simpson
*Assistant Examiner*—John Sipos
*Attorney, Agent, or Firm*—Gunn & Lee

[57] ABSTRACT

An apparatus for handling extrudable substances has a source of power for driving a series of rollers and cutters in response to a control signal. A dispenser feeds paper or other suitable wrapping material to a first set of rollers which may include a cutter for cutting the paper into sheets. The sheets of paper are fed to a second set of rollers timed by the control signal. The second series of rollers overlap the sheets of paper to provide a shingling effect. A third set of rollers, again timed with the control signal, receives the paper and a pliable substance extruded thereon. The third set of rollers includes a cutter for cutting the extruded substance at least at the area of shingling of the paper. Thereafter, the substance extruded on individual sheets of paper is separated along shingled edges and delivered by a conveyor timed with the control signal to a point for packaging. Also, a paper wrapper is timed with the control signal for wrapping the paper around the extruded substance.

22 Claims, 22 Drawing Figures

APPARATUS FOR HANDLING EXTRUDABLE SUBSTANCES

BACKGROUND OF THE INVENTION

This invention relates to an apparatus for handling extrudable substances and, more particularly, to an apparatus that will individually wrap pliable extruded substances. Components of the apparatus are interchangeable due to a track mounting feature so that different quantities of continuously extruded substances may be individually wrapped in different size packages by the apparatus.

BRIEF DESCRIPTION OF THE PRIOR ART

Many different types of apparatuses have been devised and built in the past for handling semisolid substances. In the prior apparatuses, it was almost impossible to accurately control the quantity of a substance being included in an individually wrapped package, especially if the substance was being continuously extruded and cut prior to wrapping. If the quantity of extruded material in each individual package exceeded the stated quantity by a small amount, the dollar amount represented by that variation over a period of time would be exceedingly great. To give too small a quantity in each individual package could cause problems with the appropriate regulatory authorities. Therefore, it becomes very important that each individually wrapped package contain the correct amount of extruded substance.

In the modern factories, some pliable substances (such as butter, cooking fats, candy, to name a few) are extruded onto a type of conveying apparatus while they are still in a semisolid or plastic form. The extruded substance is normally cut immediately after extrusion onto wrapping paper carried by a conveyor apparatus. The wrapping paper may then be cut (if it was not pre-cut), and each portion of the extruded substance individually wrapped.

An apparatus for handling pliable substances is shown in Redmond (U.S. Pat. No. 3,129,546). However, Redmond does not have a true extruder, but instead uses a drum with radial plungers to measure individual portions of the substance before depositing. The portions are individually covered on the top and bottom with separate layers of paper.

Another apparatus using a rotating drum with radially extending plungers for handling plastic materials is shown in McClatchie (U.S. Pat. No. 2,010,523). In McClatchie, the extrusion process is not continuous so that the plastic material will have a continuous flow on some type of conveyor means. Due to a lack of continuous flow, the volume that can be handled by the apparatus as shown in McClatchie is limited. McClatchie does not have any provisions for altering the size or quantity of the plastic material being wrapped in individual packages. Also, there is no provision for altering the quantity of plastic material that may be handled per hour by the apparatus shown in McClatchie.

The inventor of the present application has been active in the field of handling pliable extrudable substances for a number of years. A prior patent by the present inventor is U.S. Pat. No. 2,678,493 issued on May 18, 1954 showing a cutting machine used to form sheets of butter or margarine. The patent consisted basically of a free wheeling drum with cutting blades located thereon. Movement of the substances to be cut caused the rotation of the drum and cutting blades.

A more complicated patent having the present inventor as a co-inventor thereon is Elmer (U.S. Pat. No. 3,307,503) which shows a multiple extrusion apparatus for forming individual candy bars. In such a multiple extrusion apparatus, it was important to have equal individual amounts being deposited from each of the extruding tubes. Each of the candy bars would be coated and individually wrapped after extrusion onto a conveyor.

Each of the above described machines are typical of apparatuses currently available to the public. However, as the size of processing plants have increased, it is very important that the capacity of apparatuses handling extrudable substances also increase. As the quantity of the substance extruded is increased, it becomes more difficult to control the measurements, yet at the same time, it becomes more important to give accurate measurements. As the volume of flow of the extruded material is increased, it is very important to have a continuous extrusion process without interruption.

SUMMARY OF THE INVENTION

It is an object of the present invention to provide an apparatus for handling extrudable substances.

It is another object of the present invention to provide an apparatus for receiving and wrapping extrudable substances in individual packages of predetermined size and quantity.

It is yet another object of the present invention to provide an apparatus for handling a continuously extruded substance, and to measure predetermined quantities of the extruded substance onto individual sheets of wrapping material. Component parts of the apparatus may be rearranged and interchanged to change the size of the packages of the extruded substance and the quantities contained therein.

In at least a preferred embodiment, the apparatus includes a plurality of dispensing rolls for continuously feeding a roll of paper to a first set of rollers that receive and cut the papper into individual sheets at a predetermined rate as regulated by a control signal indicating flow of the extruded substance.

A second set of rollers also timed by the control signal receives the individual sheets of paper, and overlaps the leading and trailing edges thereof to provide a shingling effect. The second set of rollers feed the shingled sheets of paper to a third set of rollers that receive the extruded substance thereon. A cutting mechanism, which may contain a plurality of cutting blades, cuts the extruded substance in a manner perpendicular to its direction of flow. A wedge-shaped cut is avoided by the cutting blades being maintained perpendicular to the extruded substance. A cut is always included at least at the shingled portion of the overlapping sheets. The substance cutters and third set of rollers are again timed with the control signal. Thereafter, the cut extruded substance located on the shingled sheets of paper is fed to a conveyor timed by the control signal to separate each of the individual sheets of paper and the extruded substance contained thereon. A wrapping mechanism also operated by the control signal has a camming device causing arms to extending against the top of paper and the extruded substance from below the conveyor to wrap the individual sheets about the extruded substance. Thereafter, the individually wrapped packages of extruded substance are fed to either a manual or automated packaging device.

By having a plurality of rolls of paper and a pivotal mechanism, a new roll of paper may be inserted while the prior roll is continuously feeding the first set of rollers. Thereafter, by changing positions of the rolls through a pivotal mechanism, the new roll may be started immediately prior to termination of the depleted roll.

By having a track mounted structure for the rollers, cutters and conveyor, the quantity and size of extruded material contained in each individually wrapped package can be varied. Also, the number of cuts in the extruded substance for each individually wrapped package may be varied by varying the number of cutter blades and dividing walls in the extrusion head.

If, during start-up conditions, maintenance or for any other reason, the wrapping mechanism should not function, a clutch will stop the operation of the wrapping mechanism while allowing all other functions of the apparatus to be performed.

By having a common motor drive regulated by a single control signal indicating the rate of flow through the extrusion mechanism, the rollers, cutters, conveyor and wrapper may be timed from the common motor drive by an appropriate mechanical gearing arrangement. However, it is also feasible to have additional motor drives operating as a slave unit to either a master motor drive unit or the control signal.

Figure 4A:
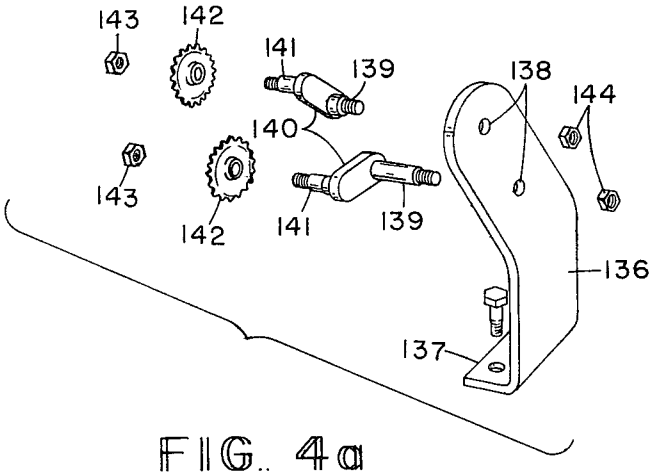
FIG. 4 is a partial elevated view from the side opposing FIG. 2 to illustrate drive connections for the substance cutter.
Figure 4:
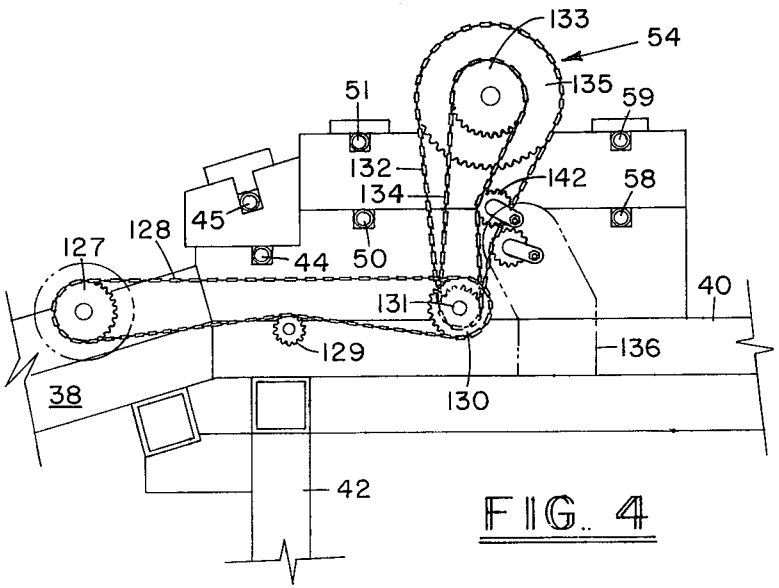

FIG. **4*a* is an exploded perspective view of a tension device for maintaining tension on the chains shown in FIG. 4**.

Figure 5:
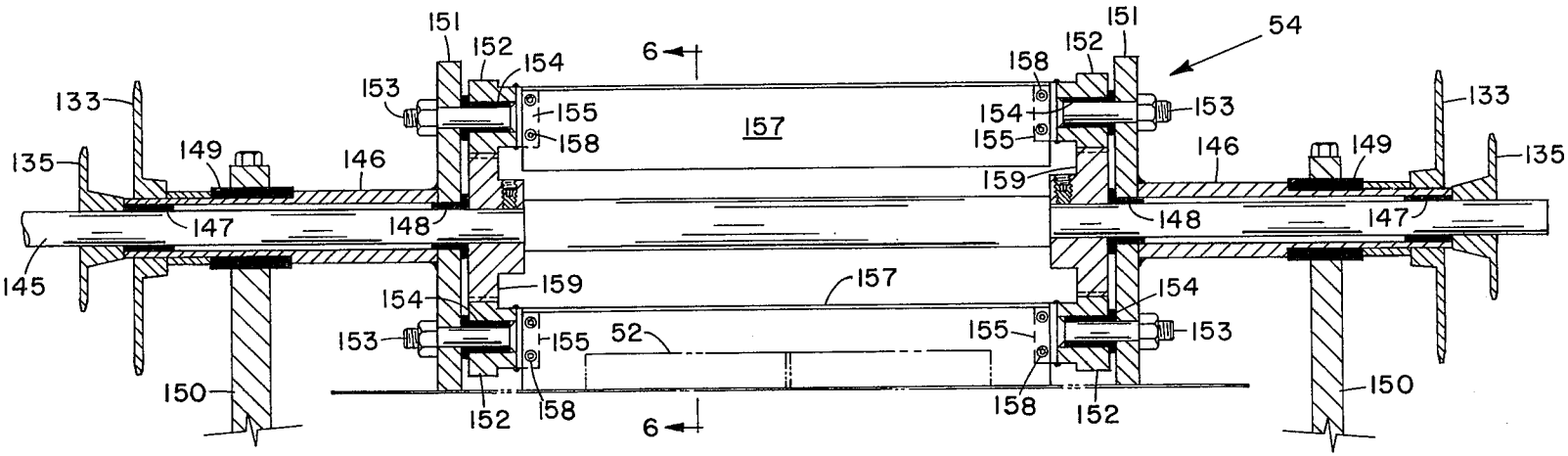

FIG. 5 is an elongated sectional view of the extrudable substance cutter.

Figure 6:
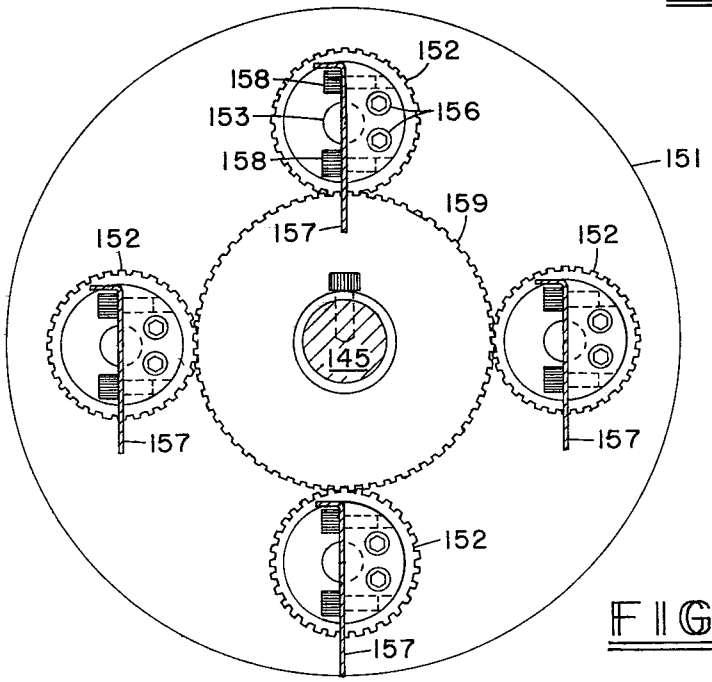

FIG. 6 is a sectional view along section lines 6—6 of FIG. 5.

Figure 7:
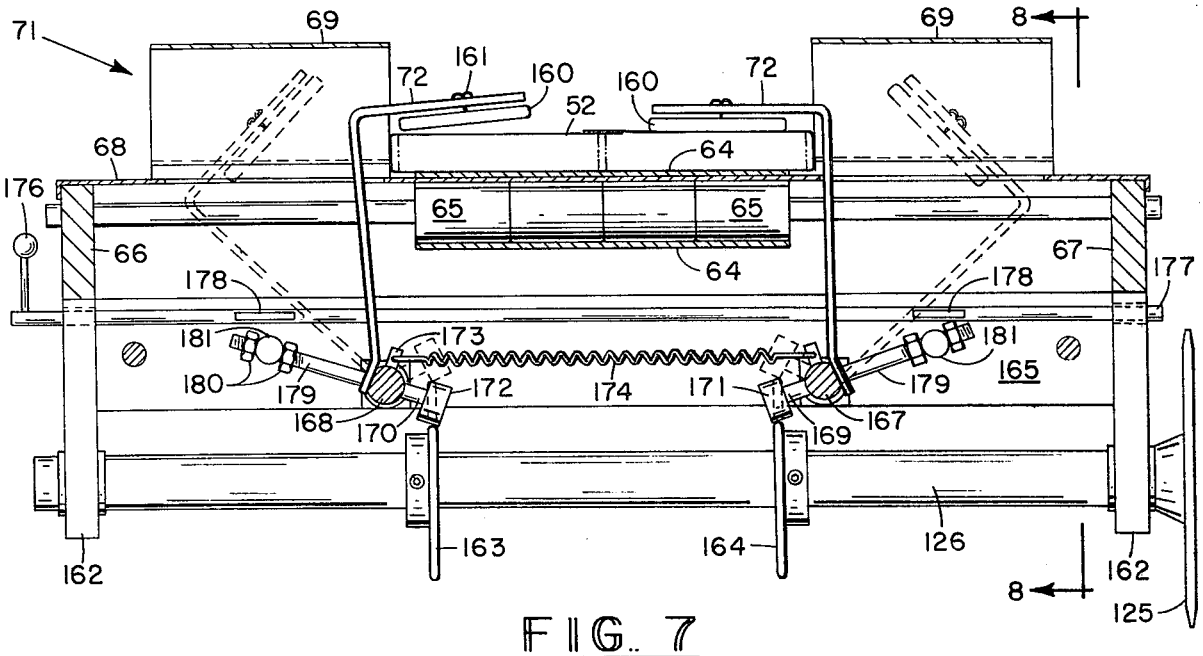

FIG. 7 is a partial sectional view of the conveyor and wrapping mechanism.

Figure 8:
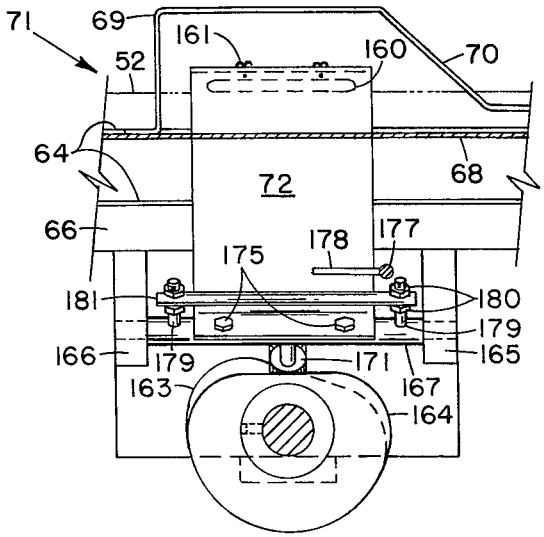
Figure 9A:
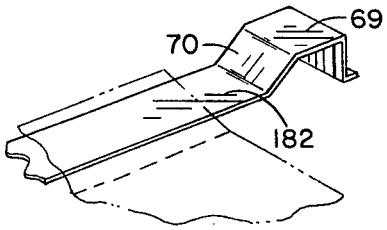
Figure 9B:
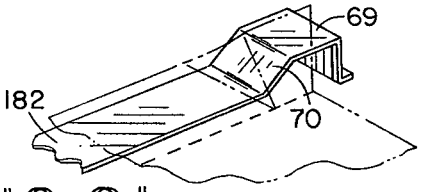
Figure 9C:
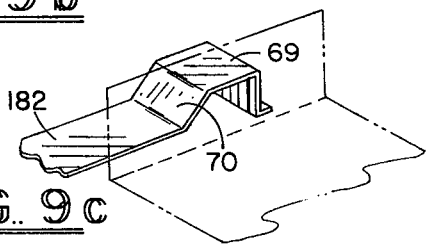
Figure 9D:
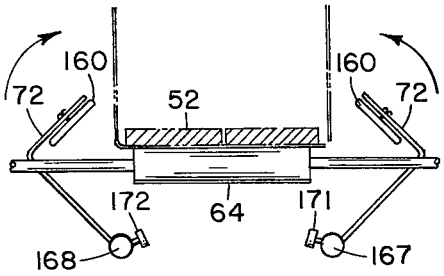
Figure 9E:
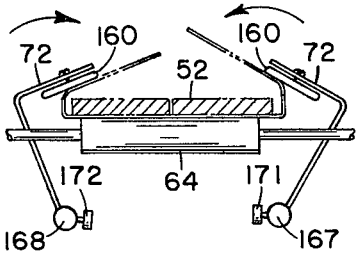
Figure 9F:
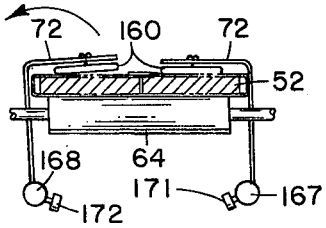

FIG. 8 is a sectional view along section lines 8—8 of FIG. 7.

FIGS. **9*a*, 9*b* and 9*c*** are illustrative sequential pictorial view showing the plowing of the edges of the paper to the vertical direction.

FIGS. **9*d*, 9*e* 9*f*** are illustrative sequential pictorial views showing the wrapping of the paper around the extruded substance.

Figure 10:
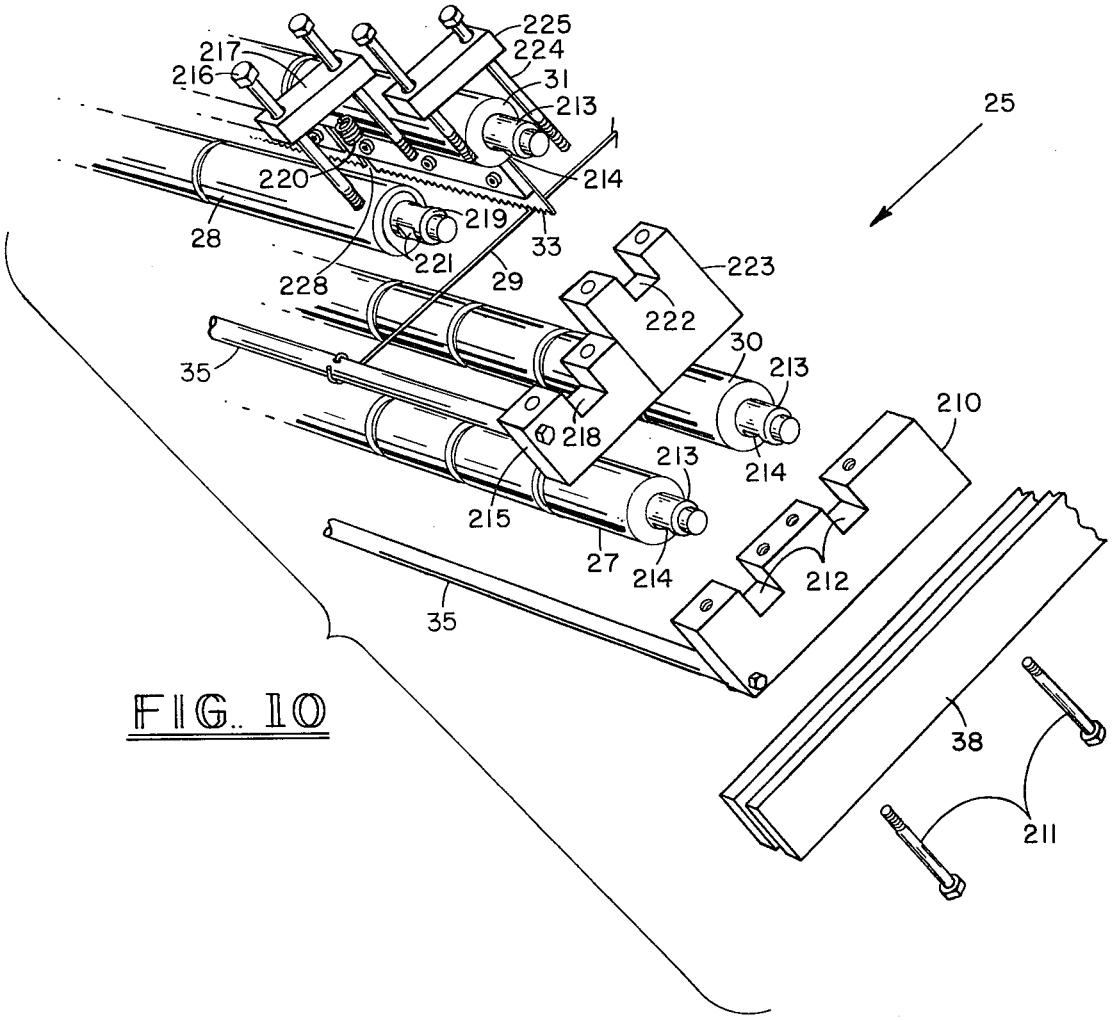

FIG. 10 is a partially exploded perspective view of one set of rollers illustrating modular construction of the apparatus.

Figure 11:
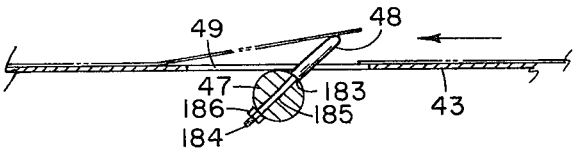

FIG. 11 is a schematic sectional view illustrating the shingling of individual sheets of paper.

FIGS. **12*a*, 12*b*, 12*c* and 12*d*** are illustrative side views showing operation of the dispensing mechanism for providing a continuous feed of paper to the apparatus.

Figure 13:
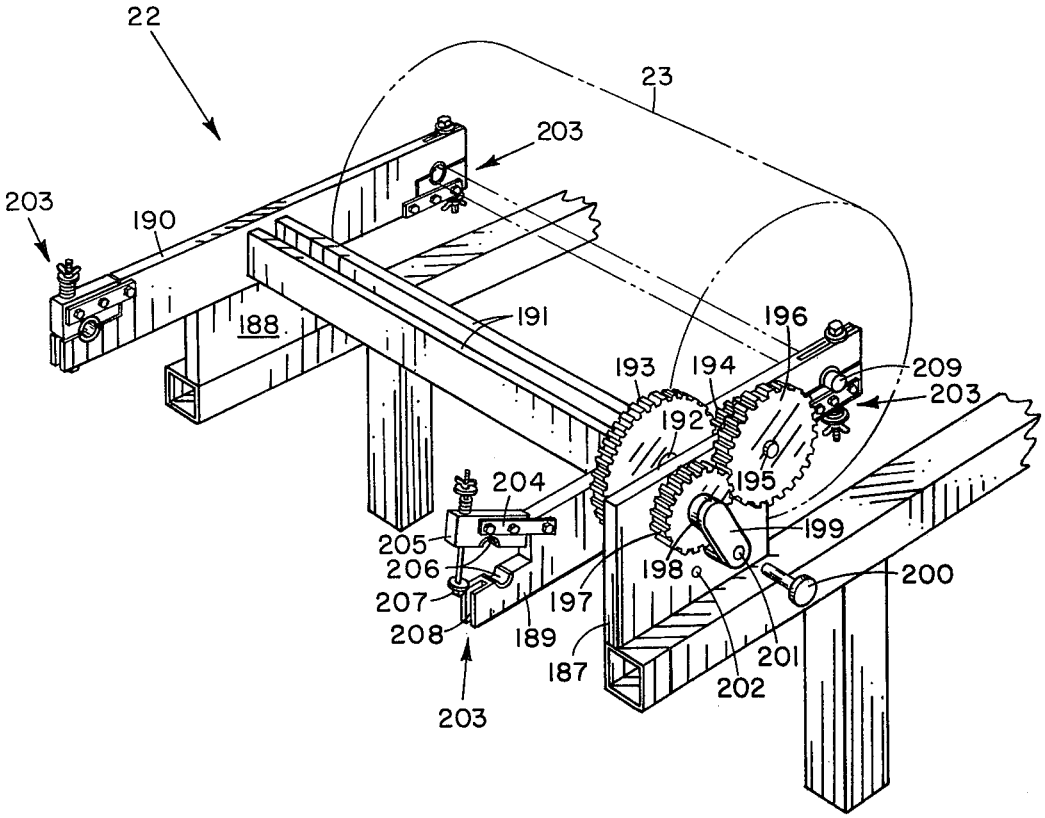

FIG. 13 is a more detailed perspective view of the dispensing mechanism.

DESCRIPTION OF THE PREFERRED EMBODIMENT

The present apparatus as will be described in detail hereinbelow will handle various types of pliable extrudable substances in a semisolid or plastic form and individually wrap predetermined quantities of the extruded substances. The extruded substance may consist of such items as butter, margarine, candy, shortening, cooking fats or numerous other substances. However, hereinafter in the present application, the extruded substance will be referred to as cooking fats commonly used by fast-food restaurants in deep fat fryers.

Figure 1:
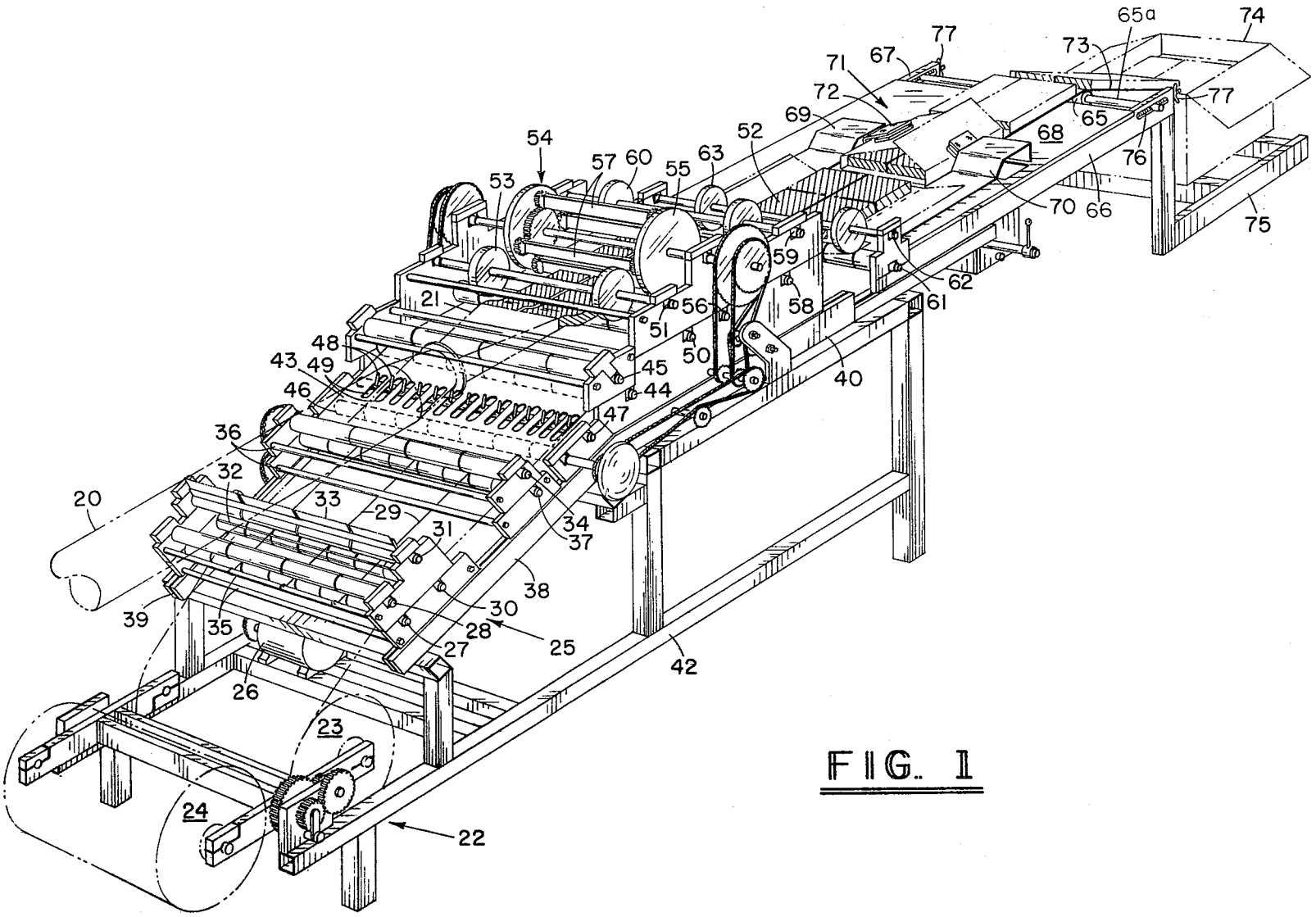
FIG. 1 is a perspective view of an apparatus for handling and wrapping extrudable substances in individual packages of a predetermined size and quantity.

Referring now to FIG. 1 of the drawings, there is shown a perspective view of the entire apparatus for handling cooking fats received through the extrusion conduit 20 and extruder head 21. A dispensing mechanism 22 is adapted to receive rolls of paper 23 and 24. One of the paper rolls, such as paper roll 23, is fed into a first set of rollers 25 driven by motor 26 in a manner as will be subsequently explained in more detail. The paper is fed between lower draw roller 27 and upper draw roller 28. The turning motion of lower draw roller 27 and upper draw roller 28 about their respective longitudinal axis and the friction therebetween causes a continuous feed of paper. Thereafter, the paper feeds from lower and upper draw rollers 27 and 28, respectively, between a lower paper tray (not shown to illustrate lower rollers) and upper guide wires 29 over slotted roller 30. Due to rotational motion of slotted roller 30 and paper cutter 31, the cutter blade 33 will periodically insert into slot 32 to cut the paper. It should be realized that circular grooves are provided in the upper draw roller 28, cutter blade 33 and upper tension roller 34 to prevent interference by the upper guide wires 29. The upper guide wires 29 connect to cross braces, such as cross braces 35 and 36, with the further connection not shown.

Immediately below the upper tension roller 34 is a lower tension roller 37, both of which are driven by motor 26 in a manner as will be subsequently explained in more detail. The upper and lower tension rollers 34 and 37, respectively, tend to pull the paper therebetween at a faster speed than upper and lower draw rollers 27 and 28, respectively, thereby creating a tension on the paper located between the sets of rollers to aid the cutting of the paper into sheets by cutter blade 33. Again, the paper feed tray is not shown between the tension rollers 34 and 37 and the draw rollers 27 and 28 to show lower rollers.

All of the rollers previously described are mounted on each end thereof on inclined tracks 38 and 39. The inclined tracks 38 and 39 connect to horizontal tracks 40 and 41 (shown in subsequent figures). The tracks 37, 38, 39 and 40, the motor 26 and the dispensing mechanism 22 are all supported by support structure 42.

The paper which has now been cut into sheets by the paper cutter 31 is fed along slotted plate 43 to lower overlap roller 44 and upper overlap roller 45. The overlap rollers 44 and 45 turn at a speed less than the tension rollers 34 and 37. Therefore, the individual sheets of paper which have been separated by the faster speed of the tension rollers 34 and 37 than the draw rollers 27 and 28 will now be slowed down. A paper lifter and product drive cutter 46 shown in dotted lines below slotted plate 43 is connected to paper lifter 47 to cause rotation thereof. The paper lifter 47 has a series of fingers 48 extending perpendicular therefrom, which fingers rotate through slots 49 to lift the trailing edge of each sheet of paper to cause an overlapping or shingling effect as will be explained in more detail subsequently.

The sheets of shingled paper feed from the overlap rollers 44 and 45 to the lower lock roller 50 and the upper lock roller 51. Because cooking fats 52 are simultaneously being extruded through extruder head 21 onto the sheets of shingled paper as it is fed through locking rollers 50 and 51, upper lock roller 51 has a pair of roller wheels 53 rigidly connected thereto on each side of the extruded cooking fats in rotational contact with lower lock roller 50 with the cutter edges of the sheets of paper therebetween.

From the lock rollers 50 and 51, the shingled sheets of paper with the cooking fats 52 extruded thereon feed below a product cutter indicated generally by reference numeral 54. The product cutter 54 is driven by the motor 26 as will be subsequently explained in more detail and is in rotational contact through a pair of roller wheels 55 with lower product roller cutter 56. The blades 57 of the product cutter 54 are always maintained perpendicular to the cooking fats 52. Also, the product cutter 54 is timed with the motor 26 so that the extruded fats 52 are cut at least at the point of overlapping or shingling of the individual sheets of paper.

From the product cutter 54 and lower product cutter roller 56, the shingled sheets of paper with the cut cooking fats located thereon are fed to lowerhold roller 58 and upper hold roller 59 which are rotating at the same speed as overlap rollers 44 and 45 and product cutter 54. The upper hold roller 59 also has a pair of roller wheels 60 rigidly connected thereto and in rotational contact with the lower hold roller 58 on each side of the cut cooking fats 52. From the hold rollers 58 and 59, the shingled sheets of paper and cooking fats are fed along a downward sloping plate (not shown) to a conveyor drive roller 61 and a separator roller 62. Again, the separator roller 62 has a pair of roller wheels 63 in rotational contact with the conveyor drive roller 62 on each side of the extruded cut cooking fats 52. Due to the rotational speed of the separator roller 62, the conveyor drive roller 61 moves the cooking fats 52 at a speed faster than the cooking fats move between hold rollers 58 and 59. Therefore, the conveyor drive roller 61 and the conveyor belt 64 (shown in subsequent views) move the cooking fats at a faster speed thereby causing separation at the point of overlap or shingling of the individual sheets of paper. The conveyor belt 64 is connected on the opposite end thereof to conveyor driven roller 65.

Connected to the horizontal tracks 40 and 41 are conveyor tracks 66 and 67, respectively. Extending between the conveyor tracks 66 and 67, and immediately below the conveyor belt 64, is a plate 68. Mounted on the plate 68 is a pair of plows 69 that extend immediately adjacent to conveyor drive roller 61 for receiving the edges of the individual sheets of paper thereon. As the cooking fats 52 and individual sheets of paper move along conveyor belt 64, the plows 69 raise the outer edges of the paper to a vertical position by sliding the edges along inclined slope 70. A wrapping mechanism 71 has a pair of wrapper arms 72 extending from below the plows 69 and through holes in the plate 68 to fold the individual sheets of paper against the cooking fats 52 to provide a "wrapped around" product. The wrapped around product is further moved by the conveyor belt 64 through a guide chute 73 to a waiting container 74 on a loading platform 75. The final stage of loading the individually wrapped packages of cooking fats 52 into container 74 may either be fully automated or manual.

Tension on the conveyor belt 64 is maintained by threaded rods 76 extending from the end of conveyor tracks 66 and 67 into a threadable connection with the end of fixed shaft **65*a* which supports conveyor driven roller 65. The threaded rods 76 are rigidly connected to wing nuts 77**.

Figure 2:
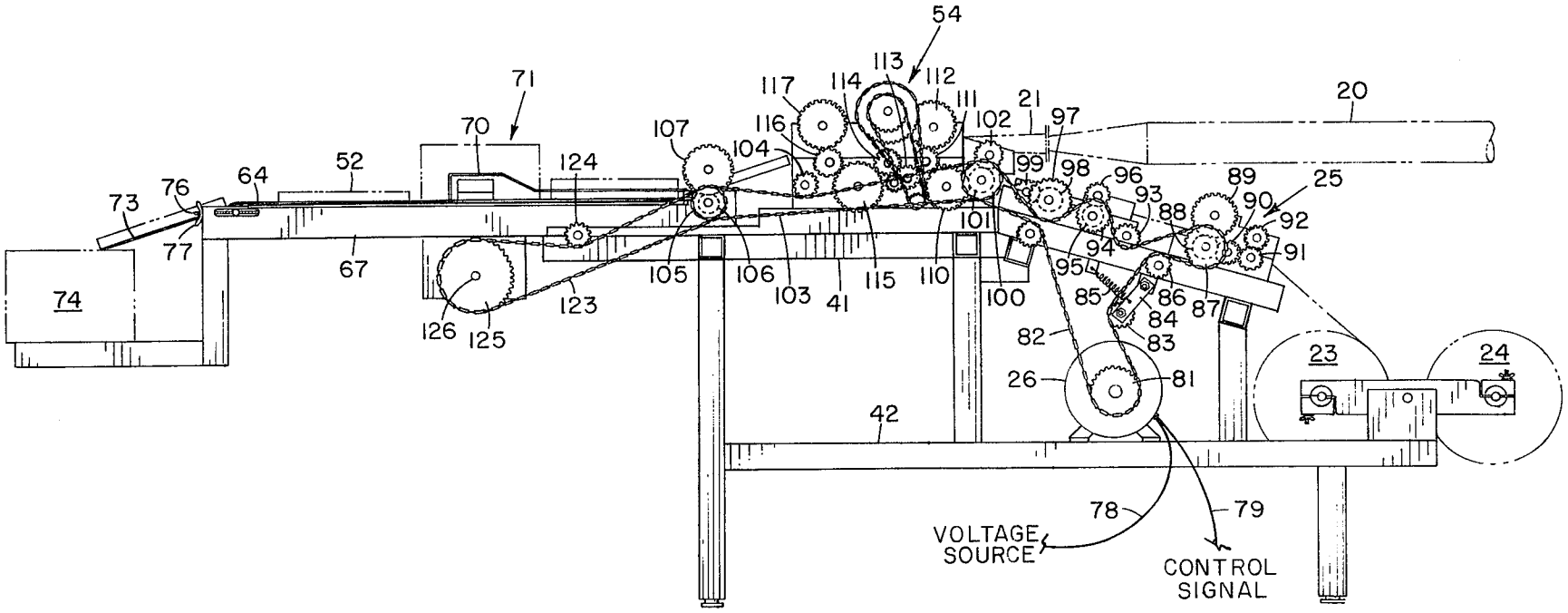
FIG. 2 is an illustrative elevated side view of FIG. 1 showing drive connections to the various rollers, cutters, conveyor and wrapper.

Referring now to FIG. 2 of the drawings, a pictorial side view of FIG. 1 is shown illustrating the drive mechanism of the present invention. The motor 26 receives its power from suitable voltage source through cable 78. The speed of operation of the motor 26 may be varied by a control signal received through cable 79. The control signal indicates the rate of flow of the cooking fats through the extruder head 21 onto the present apparatus. Such a control signal indicating rate of flow may be obtained from a flow meter, a positive displacement pump which is forcing the cooking fats through the extruder head 21, a positive displacement pump in line with extrusion conduit 20 and driven by the cooking fats being extruded, just to name a few ways to generate a signal accurately indicating the rate of flow of the cooking fats. The motor 26 may be an independently operated motor, the speed of which is regulated by control signal 79, or it may be a slave motor to another motor drive regulated by the control signal. In any event, the turning of drive sprocket 81 is regulated by the control signal which controls the rotational speed of motor 26.

The chain 82 connects through chain idler 83 which keeps tension upon chain 82 by hinge support bar 84 and spring 85. From chain idler 83, the chain 82 extends over chain idler 86 to connect to sprocket 87 rigidly mounted on one end of slotted roller 30. Immediately adjacent to sprocket 87 and rigidly mounted to the slotted roller 30 is a drive gear 88. The drive gear 88 turns paper cutter gear 89 and idler gear 90. Idler gear 90 further turns lower draw gear 91 rigidly connected to lower draw roller 27. The lower draw gear 91 further turns upper draw gear 92 rigidly connected to upper draw roller 28.

By the interconnection of sprocket 87 and gears 88 thru 92 as described hereinabove, the first set of rollers 25 are driven by the motor 26. Rotational speed of the various rollers are controlled by the size of the gears 88 thru 92 with the circumference of paper cutter gear 89 being twice the circumference of drive gear 88 thereby resulting in one rotation of the paper cutter 31 for every two rotations of the slotted roller 30.

The chain 82 further continues below chain idler 93 and above lower tension sprocket 94 which connects to lower tension roller 37. Also rigidly connected to lower tension roller 34 inside of lower tension sprocket 94 is lower tension gear 95. Lower tension gear 95 turns upper tension gear 96 that is rigidly connected to upper tension roller 34. By controlling the number of teeth in lower tension sprocket 94, the tension rollers 34 and 37 will rotate slightly faster than draw rollers 27 and 28.

From lower tension sprocket 94, the chain 82 further extends under paper lifter and product drive sprocket 97 which is rigidly connected to paper lifter and product drive cutter 46. Also rigidly connected thereto is paper lifter and product drive gear 98. Paper lifter and product drive gear 98 rotatably connect to paper lifter gear 99 which is rigidly connected to the paper lifter 47.

By the proper sizing of gears 98 and 99 and sprocket 97, the paper lifter 47 can be timed so that the fingers 48 will lift the end of each sheet of paper to allow for the overlapping or shingling effect.

Next, the chain 82 extends over lower overlap sprocket 100 rigidly connected to lower overlap roller 44. Also connected rigidly to the lower overlap roller 44 is lower overlap gear 101. Lower overlap gear 101 causes rotational motion of upper overlap gear 102 which is rigidly connected to upper overlap roller 45. By proper selection of gears 101 and 102 and sprocket 100, the overlap rollers 44 and 45 will operate at a slightly slower speed than tension rollers 34 and 37 thereby causing the overlapping of shingling effect in conjunction with paper lifter 47.

A conveyor drive chain 103 connects to an internal sprocket (not shown) also rigidly connected to lower overlap roller 44. The conveyor drive chain extends under idler gear 104 and over conveyor drive sprocket 105 which is rigidly connected to conveyor drive roller 61. Also rigidly connected to conveyor drive roller 61 is conveyor drive gear 106. Conveyor drive gear 106 causes rotational motion of separator gear 107 which is rigidly connected to separator roller 62. By proper selection of the size of gears 106 and 107 and sprocket 105, the conveyor belt 64 will move the individual sheets of paper and extruded cooking fats 52 contained thereon at a speed faster than they will move through hold rollers 58 and 59.

Lower overlap gear 101 also causes rotational motion of idler gear 110 which in turn causes rotational motion of lower lock gear 111 rigidly connected to lower lock roller 50. Lower lock gear 111 in turn causes rotational motion of upper lock gear 112 which is rigidly connected to upper lock roller 51. Also, lower lock gear 111 turns idler gear 113 which in turn causes rotational motion of lower product cutter gear 114. Lower product cutter gear 114 in turn causes rotational motion of idler gear 115 which causes further rotational motion of lower hold gear 116 that is rigidly connected to lower hold roller 58. Lower hold gear 116 causes rotational motion of upper hold gear 117 which is rigidly connected to upper hold roller 59.

Operation of the product cutter 54 will subsequently be described in conjunction with FIG. 4 in more detail.

A second sprocket (not shown) is rigidly connected to conveyor drive sprocket 105 and conveyor drive gear 106 for rotation with the conveyor drive roller 61. The second sprocket has a folder drive chain 123 connected thereto which extends below chain idler gear 124 and over folder cam shaft sprocket 125 which drives folder cam shaft 126. The operation of the folder or wrapping mechanism 71 operated by the folder cam shaft 126 will be described in more detail subsequently.

Referring to FIG. 4 of the patent application a partial side view opposing the side shown in FIG. 2 is illustrated to better understand the drive for the product cutter 54. A drive sprocket 127 is rigidly located on paper lifter and paper drive cutter 46. Cutter drive chain 128 extends over idler gear 129 and around cutter sprocket 130. The cutter sprocket 130 is mounted on one end of counter shaft product cutter 131. The turning of counter shaft product cutter 131 also turns internal sprockets (not shown), which internal sprockets are connected through chain 132 to the cutter maintainer sprocket 135 and through chain 134 to cutter rotational sprocket 135. The counter shaft product cutter 131 also drives a similar set of sprockets on the opposite side of product cutter 54. Operation of the product cutter 54 will be explained in more detail in conjunction with FIGS. 5 and 6.

Referring now to FIG. 4*a*, a mounting bracket 136 has a flange 137 on the lower end thereof which may be attached to horizontal track 40 or the support structure 42 immediately adjacent to counter shaft product cutter 131. In the upper portion of the mounting bracket 136 are holes 138 for receiving bolts 139 therethrough. On the opposite side of bolts 139 are offset members 140 having additional bolts 141 extending from the opposite end thereof, but offset from bolts 139. Mounted on bolts 141 are chain idlers 142 which are held in position by nuts 143. Likewise, bolts 139 are held in holes 138 of mounting bracket 136 by nuts 144. By rotation of the offset member, the chain idlers 142 can be pressed against their respective chain 132 or 134 to maintain the chain in a tight condition. The mounting bracket 136 and chain idlers 142 mounted thereon are shown in outline form in FIG. 4.

It should be realized that while the product cutter 54 is shown only as being driven on the side shown in FIG. 4, it could be driven on both sides. In fact, counter shaft product cutter 131 does extend through to the opposite side of the apparatus as shown in FIG. 2 to provide a positive drive to both sides of the product cutter 54. Referring to FIG. 5, the product cutter 54 is shown in a longitudinal cross-sectional view. The cutter maintainer sprocket 135 is rigidly mounted on the cutter maintainer shaft 145. The cutter maintainer shaft 145 is pivotally carried inside of cutter rotation cylinder 146 and rides on end bearings 147. Also, the cutter maintainer shaft rides on inside bearings 148 located at the innermost portion of the cutter rotation cylinders 146.

Rigidly mounted to the outermost ends of the cutter rotation cylinders 146 are the cutter rotation sprockets 133. As the cutter rotation sprockets 133 turn, the cutter rotation cylinders 146 will also turn inside of support bearings 149 rigidly mounted in the supporting walls 150 carried by horizontal tracks 40 and 41. Rigidly mounted on the innermost ends of the cutter rotation cylinders 146 are cutter rotation wheels 151 which have holes in the centers thereof for receiving the cutter maintainer shaft 145 therethrough. The rigid mounting of the cutter rotation wheels 151 on cutter rotation cylinders 146 may be of any conventional means, such as welding.

Referring now to FIGS. 5 and 6 in combination, mounted on the inside of the cutter rotation wheels 151 are a plurality of cutter blade gears 152 with the present preferred embodiment showing four. The cutter blade gears 152 are carried on shafts 153, and the cutter blade gears 152 rotate on bearings 154. The innermost side of the cutter blade gears 152 have a mounting bracket 155 held in position by set screws 156. Connected to each of the mounting brackets 155 between each of the cutter rotation wheels 151 are cutter blades 157. The cutter blades 157 are held to the mounting brackets 155 by screws 158.

Rigidly mounted on the cutter maintainer shaft 145 just inside of each of the cutter rotation wheels 151 are cutter maintainer gears 159. The cutter maintainer gears 159 inter-mesh with each of the cutter blade gears 152 mounted on the respective cutter rotation wheels 151. By proper selection of the sprockets 133 and 135, and the gears 152 and 159, the cutter blades 157 can be maintained in a vertical position with the simultaneous rotation of the cutter rotation wheels 151. It is important that the cutter blades 157 be maintained perpendicular with the cooking fats 52 by cutter maintainer gears 159 and cutter blade gears 152. Also, it is important that the cutter blades 157 move at the same speed as the cooking fats 52 move thereunder. By use of a product cutter 54 as just described hereinabove, a perpendicular cut is made in the cooking fats 52 each time a blade 157 moves to the bottom of the cutter rotation wheel 151. In the present system, by proper selection of the various sprockets and gears, the cutter blades are timed to cut the cooking fats 52 at the point of overlap or shingling of the sheets of paper. By the use of four cutter blades as shown hereinabove, the present preferred embodiment makes an additional cut in the middle of the product contained on each individual sheet.

Just as it should be realized that the size of the sheets may be varied by changing the first set of rollers and by proper adjustment of subsequent rollers, it is also possible to vary the points where the cutter blades 157 will cut the extruded cooking fats 52 or other products by simply varying the number of cutter blades located on cutter rotation wheels 151 or by varying the sizes of the sprockets and gears. Also, while the timing of the cutter blades 157 is controlled by a mechanical linkage, the timing could also be controlled by an electrical connection with appropriate electrical controls.

To prevent cooking fats from collecting on the blades 157 of the product cutter 54, a heating lamp will be located immediately above and adjacent to product cutter 54. The radiated heat will heat the blades 157 to melt any cooking fats that may collect thereon.

Referring to FIGS. 7 and 8 in combination, the wrapping mechanism 71 will be shown in more detail. The plows 69 are mounted on plate 68 which is attached to conveyor tracks 66 and 67. As the cooking fats 52 and individual sheets of paper are moved by conveyor belt 64 between the plows 69, the plows 69 fold the sheets of paper to a vertical position. Thereafter, the wrapping arms 72 which have floating shoes 160 connected to the underside thereof by means of pins 161, press the paper against the cooking fats 52 as shown in FIG. 7 and sequentially illustrated in FIGS. *9d–9f*. Movement of the wrapping arms 72 is controlled by rotation of the folder cam shaft sprocket 125 and the folder cam shaft 126. The folder cam shaft 126 is held in position by support structure 162 rigidly connected to conveyor tracks 66 and 67. Mounted on the folder cam shaft 126 is a pair of cams 163 and 164 for rotation therewith. Both of the cams 163 and 164 are basically circular with one relatively flat spot thereon. One of the cams is designed to lead the other by several degrees so that one edge of the sheet of paper and the respective wrapping arm 72 will be folded against the cooking fats 52 prior to the other edge of the sheet of paper and its respective wrapping arm 72. As shown in FIG. 8, cam 163 trails cam 164 to a slight degree.

Extending between a front wall 165 and rear wall 166 are rocker shafts 167 and 168. Extending perpendicular from approximately the center of the rocker shafts 167 and 168 are roller shafts 169 and 170, respectively. On each end of the roller shafts 169 and 170 are rollers 171 and 172 which follow cams 164 and 163, respectively. Also connected perpendicular to the rocker shafts 167 and 168 are spring bolts 173 for maintaining tension spring 174 therebetween. Tension spring 174 maintains rollers 171 and 172 against cam 164 and 163, respectively. Each of the wrapping arms 72 extend downward to the rocker shafts 167 and 168 and are connected to a flat surface thereon by means of screws 175.

Referring now to the sequence shown in FIGS. *9d* and *9e*, the sequential motion of the folding arms 72 as the rollers 171 and 172 follow cams 164 and 163, respectively, will be illustrated. As the rollers 171 and 172 follow the circular portion of the cams 164 and 163, respectively, the wrapping arms 72 will be maintained in the position as shown in FIG. *9d*. As the rollers 171 and 172 begin to move into the flat portion of the cams 164 and 163, respectively, the wrapping arms 72 will move as shown in FIG. *9e*. While the rollers 171 and 172 never simultaneously reach the center of the flat surfaces of their respective cams 163 and 164, the wrapping arms 72 will be in the position approximately as shown in FIG. *9f*. Thereafter, the wrapping arms 72 will move back to the position as shown in FIG. *9d* as the rollers 171 and 172 move to the circular portion of their respective cams 164 and 163.

Referring back to FIGS. 7 and 8, a clutch to prevent operation of the wrapping arms 72 is shown. The clutch has an operator arm 176 connected to clutch shaft 177. Extending horizontal from and perpendicular to the clutch shaft 177 is a pair of lever arms 178. Perpendicular to rocker shafts 167 and 168 are two clutch arms 179 on each end thereof. Held into position on each end of the clutch arms 179 by means of nuts 180 are clutch bars 181. If the operator arm 176 is pushed downward, the lever arms 178 will press against the clutch bars 181 thereby rotating rocker shafts 167 and 168 against the force of the tension spring 174. As the lever arms 178 move approximately perpendicular to the clutch bars 181, a person can release the operator arm 176 and it will remain in the same position because of the perpendicular forces exerted by the lever arms 178 against the clutch bars 181. This will completely eliminate the wrapper arms 72 from the operation of the present apparatus. Such a feature is desirable during testing, maintenance or for some types of products wherein a sheet of paper is only necessary on one side thereof.

As illustrated in FIGS. *9a–9c*, the plows 69 receive the individual sheets of paper immediately adjacent to conveyor drive roller 61 by the extended forward portion 182. Thereafter, as the paper moves along the extended forward portion 182, it will be forced upward to the vertical position by inclined slope 70 as shown in FIG. *9b* until the edges of the sheets of paper reach the vertical position as shown in FIG. *9c*.

Figure 3:
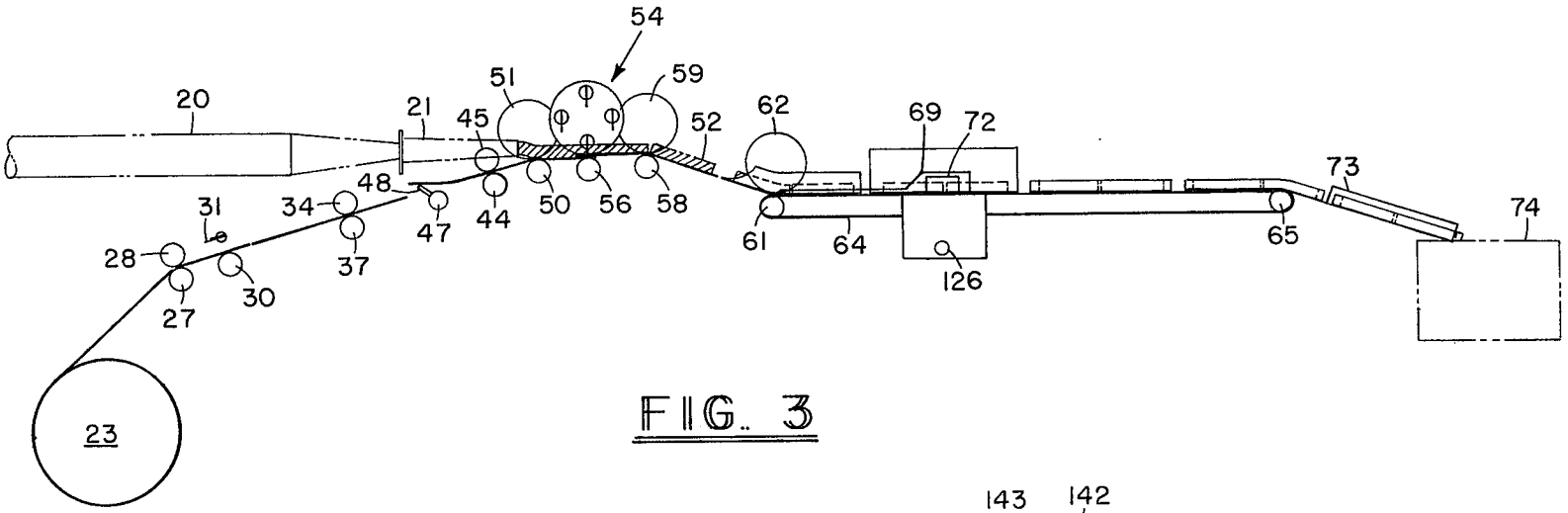
FIG. 3 is an illustrative side view of FIG. 1 to show flow and movement of the wrapping paper and extruded substance.

Referring to FIG. 3 for a simplified explanation of the operation of the entire apparatus, the roll of paper is fed through draw rollers 27 and 28, and further fed over slotted roller 30 to the tension rollers 34 and 37. As tension on the paper is created, the paper cutter 31 will rotate with the slotted roller 30 to cut the paper while it is under tension. The tension is created by a slightly faster rotational speed of tension rollers 34 and 37 than draw rollers 27 and 28. Thereafter, the individual cut sheets of paper are fed over paper lifter 47 to overlap rollers 44 and 45 which are rotating at a speed less than tension rollers 34 and 37. As the sheets of paper are slowing down, a paper lifter 47 with the fingers 48 thereon will lift the trailing edge of each sheet of paper thereby allowing the next sheet of paper to be extended thereunder. From the overlap rollers 44 and 45, the shingled sheets of paper are fed to lock rollers 50 and 51 which also receive the extruded cooking fats 52 through the extrusion head 21 onto the shingled sheets of paper.

The shingled sheets of paper with the extruded cooking fats 52 thereon are further fed over the lower product cutter roller 56 to the hold rollers 58 and 59. Simultaneously, the product cutter 54 cuts the product at least at each point of overlap of the individual sheets of paper, and possibly therebetween. Thereafter, the shingled sheets of paper with the extruded cut cooking fats 52 located thereon are fed to conveyor drive roller 61 and separator roller 62 which are traveling at a speed slightly greater than the hold rollers 58 and 59 thereby causing separation of each of the sheets of paper at the point of overlap. As the extruded cooking fats 52 move along conveyor belt 64, the folder cam shaft 126 and wrapping arms 72, in conjunction with plows 69, wrap the edges of the individual sheets of paper about the extruded cooking fats 52. Thereafter, the individually wrapped packages of cooking fats 52 are transferred along the conveyor belt 64 and guide chute 73 to the waiting container 74.

By having a drive source or motor that is dependent upon the flow of the extruded cooking fats 52, the entire apparatus as just described in conjunction with FIG. 3 may be increased or decreased in speed depending upon the rate of flow of cooking fats 52 through extrusion head 21. Also, by varying the timing of the separate functions just described, the sizes of the individual packages may also be varied.

For a better understanding of the operation of the paper lifter 47, attention is directed to FIG. 11. As the paper moves along slotted plate 43, the paper lifter 47 is timed so that the fingers 48 pick up the trailing edge of a sheet of paper by rotating through slots 49. The leading edge of the following sheet of paper, which is traveling faster than the trailing edge of the previous sheet of paper, will be inserted thereunder. Each of the fingers 48 are connected to the finger lifter 47 by a shoulder 183 pressing thereagainst and with a threaded portion extending through a hole 185 of the paper lifter 47. A nut 186 on the opposite end securely holds the fingers 48 into position.

Figure 12A:
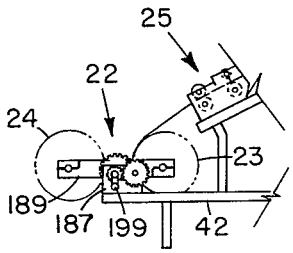
Figure 12B:
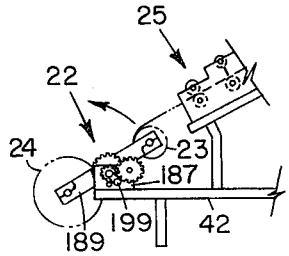
Figure 12C:
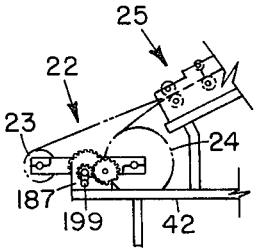

Referring now to FIGS. 12*a*–12*d*, the dispensing mechanism 22 and the operation thereof is shown in a schematic sequential presentation. Initially, paper roll 23 is feeding to the first set of rollers 25 as shown in FIG. 12*a* and is previously described in conjunction with FIGS. 1 and 2. Mounted on the support structure 42 on each side thereof are vertical plates 187 and 188 (see FIG. 13). Mounted on the vertical plates 187 and 188 are rotatable dispensing arms 189 and 190, respectively.

Figure 12D:
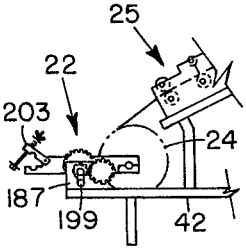

Before continuing with the sequential views as shown in FIGS. 12–12*d*, refer to FIG. 13 for a more detailed explanation of the mechanical structure of the dispensing mechanism 22. Extending between the vertical plates 187 and 188 are cross-support beams 191 with a rotational axle 192 located therebetween. The rotational axle 192 is rigidly connected on each end thereof to the rotatable dispensing arms 189 and 190, and to a large inside gear 193 on one end thereof. The large inside gear 193 turns inside reducing gear 194 mounted on a short axle 192 extending through vertical plate 187. On the opposite end of short axle 195 is a large outside gear 196 for turning outside reducing gear 197 mounted on short axle 198. It should be realized that the axles 192, 195 and 198 are recessed in the vertical plate 187 to prevent interference with any of the gears. Rigidly connected to the outside reducing gear 197 is a hand crank 199 with a spring loaded pin 200 being inserted in a hole 201 located in the opposite end thereof. The spring loaded pin 200 will normally extend into plate retaining hole 202 to maintain the rotatable expensing arms 189 and 190 in the position as shown or rotated 180° about rotational axle 192. By pulling the spring loaded pin 200 out of the plate retaining hole 202, an individual may turn the hand crank 199 which will cause outside reducing gear 197 to turn. The turning of outside reducing gear 197 will turn large outside gear 196 which also turns inside reducing gear 194 through short axle 195. The inside reducing gear 194 will turn the large inside gear 193 and rotational axle 192 rigidly mounted thereto. The turning of the rotational axle 192 will cause the rotatable dispensing arms 189 and 190 to rotate therewith. The number of gears 193, 194, 196 and 197 are necessary because of the weight of the rolls of paper, such as paper roll 23.

Referring back to FIG. 12*b* just before paper roll 23 has been used up, an individual will turn hand crank 199 to cause rotation of the dispensing arms 189 and 190 and the paper rolls 23 and 24 contained thereon as shown. After rotation through 180°, the hand crank 199 is again locked into position with spring loaded pin 200. While paper roll 23 is still feeding the first set of rollers 25, but immediately prior to using up the roll 23, roll 24 is inserted immediately therebelow into the first set of rollers 25. The remaining portion of paper roll 23 is then cut off or allowed to be used up with simply two layers of paper wrapping the cooking fats 52. Thereafter, by opening paper roll retainer 203, a new roll of paper may be inserted as shown in FIG. 12*d*.

Referring back to FIG. 13, a paper roll retainer 203 is located on diagonally opposing corners of the rotatable dispensing arms 189 and 190. The paper roll retainer 203 includes a mounting bracket 204 pivotally connected to dispensing arms 189 and 190. Also, the mounting bracket 204 is rigidly connected to a bearing block 205 having one-half of bearing 206 located therein. The other half of bearing 206 is located immediately adjacent thereto when bearing block 205 is in its closed position. A spring loaded bolt 207 extends through bearing block 205 and a slot 208 in the ends of dispensing arms 189 and 190. By loosening the spring loaded bolt 207, the paper roll retainer 203 may be opened and a roll of paper mounted on a dispensing axle 209 may be inserted in the two halves of bearing 206. By tightening the spring loaded bolt 207, the two halves of bearing 206 will press against the dispensing axle 209 to prevent a possible overrun of the paper roll to maintain the paper being dispensed in a tight condition with respect to draw rollers 27 and 28.

Referring now to FIG. 10 of the drawings, the modular construction of the present invention is shown in more detail. The inclined track 38, as well as all other tracks, has two halves with a short space therebetween. The lower mounting block 210 is connected to track 38 by means of screws 211 extending between the two halves of the inclined track 38 and threadably connecting in the lower side of lower mounting block 210. Rectangular notches 212 are cut in the top of the lower mounting block 210 for receiving bearings 213 therein. FIG. 10 shows the first set of rollers 25 and bearings 213 used on the ends of lower draw roller 27 and slotted roller 30. Because the lower draw roller 27 and slotted roller 30 are rigidly mounted inside of rectangular notches 212, and the bearing 213 should not turn, a notch 214 is provided in the bottom of bearing 213, which notch 214 rests against the bottom of rectangular notches 212 to prevent rotation of the bearings 213.

Mounting block 215 is bolted against the top of lower mounting block 210 by means of screws 216 extending through a retaining block 217 and the mounting block 215 for threadable connection with the lower mounting block 210. The mounting block 215 also has a rectangular notch 218 cut therein for receiving bearing 219 of upper draw roller 28. Because it is necessary to have some give between the draw rollers 27 and 28, a spring 220 is recessed inside of retaining block 217 for pressing against bearing 219. Also, to prevent rotation of bearing 219 while simultaneously allowing spring loaded action by spring 220, bearing 219 has notches 221 cut in each side thereof. The notches 221 are received inside of each side of the rectangular notch 218 to prevent rotation of the bearing 219 while simultaneously allowing the spring loaded action of roller 28.

While the paper cutter 31 will not be described in detail, it has a fixed bearing similar to bearing 213 which fits inside of rectangular notch 222 of mounting block 223. Again, mounting block 223 is held in position by bolts 224 extending through retaining block 225 and mounting block 223 for threadable connection with the top of lower mounting block 210. To maintain proper structural support between the inclined tracks 38 and 39, cross braces 35 are provided. The upper cross brace 35 also retains one end of upper guide wires 29 as previously described. A notch 228 is provided in cutter blade 33 to receive the upper guide wire therein to prevent interference with the normal cutting action of the blade 33. A similar notch is provided in upper draw roller 28. The small portion of the paper not cut due to the notch 228 simply tears due to the tension on the paper.

By using the modular type of construction as just described in conjunction with FIG. 10, an individual may vary just about any perimeter of the apparatus. For example, distance between cuts for the sheets of paper, the amount of overlap of each sheet, the point of cutting by the product cutters 52, just to give a few perimeters, can all be varied to produce any size of extruded product cut at just about any number of desired locations. Also, by use of the modular type of construction, each set of rollers or cutters may be independently controlled by a control signal that represents the flow of extruded material.

The bearings 213 and 219 just described in conjunction with FIG. 10 are sometimes called "sintered bronze" or "oil lite" and consist of approximately 75° bronze and 25° oil. By use of such bearings, the bearings themselves provide oil for the bearing surface and may periodically be changed due to wear thereof without any great difficulty.

I claim:

1. A method of handling and individually wrapping packages of a continuously extruded substance, said method including the following steps:

dispensing a wrapping material by dispensing means;

receiving and cutting said wrapping material into sheets by first roller means;

overlapping said sheets received from said first roller means by second roller means;

depositing said extruded substance along said overlapped sheets;

cutting said extruded substance at least at the point of overlap of said sheets with a perpendicular cutter;

separating said sheets with said extruded substance thereon;

wrapping said sheets around said extruded substance thereon to form a wrapped package; and conveying said package to a container.

2. The method as given in claim 1 including timing of the preceding steps by control means operated by a control signal proportionate to rate of flow of said extruded substance onto said overlapped sheets.

3. The method as given in claim 2 wherein said step of cutting said extruded substance includes maintaining cutter blades perpendicular to said extruded substance.

4. The method as given in claim 3 wherein said wrapping step may be periodically interrupted by clutch means.

5. The method as given in claim 3 wherein said dispensing step is continuous, said dispensing means having a plurality of rolls of wrapping material, position of which are reversable for simultaneous feed immediately prior to termination of one of said rolls and subsequent replacement of said roll upon said termination.

6. An apparatus adapted for handling pliable extrudable substances and wrapping said substances with a wrapping material, said apparatus comprising:

a source of power;

drive means operated from said source of power;

a supporting structure;

dispensing means rigidly mounted with respect to said supporting structure for dispensing said wrapping material;

first roller means mounted on said supporting structure and operated by said drive means for receiving said wrapping material from said dispensing means;

second roller means mounted on said supporting structure operated by said drive means and timed with said first roller means for receiving from said first roller means sheets of said wrapping material and shingling said sheets;

third roller means mounted on said supporting structure operated by said drive means and timed with said first roller means for receiving said shingled sheets from said second roller means and being adapted to receive said pliable extrudable substance on said shingled sheets;

substance cutter means mounted on said supporting structure and operated by said drive means and timed with said first roller means for cutting said substance extruded onto said shingled sheets, said cutting being at least at locations of said shingling;

conveyor means operated by said drive means and timed with said first roller means for receiving said extruded cut substance on said shingled sheets, said conveyor means separating said shingled sheets;

wrapping means operated by said drive means and timed with said first roller means for wrapping said sheets about said cut extruded substance;

regulating means operatively connected to said drive means for controlling speed of said drive means in response to rate of flow of said extruded substance onto said shingled sheets.

7. The apparatus as defined in claim 6 wherein said substance cutter means includes blade means with means for periodically lowering said blade means to cut said extruded substance, and means for maintaining said blade means perpendicular to extruded substance.

8. The apparatus as defined in claim 7 wherein said cutter means includes at least a first and second concentric shaft means, said first concentric shaft means attaching to a rotatable cutter wheel on which said blade means are pivotally mounted to give said means for periodically lowering, said second concentric shaft means rotatably attaching to said blade means forming at least a part of said means of maintaining.

9. The apparatus as defined in claim 6 wherein said dispensing means, first roller means, second roller means, third roller means and substance cutter means have independent modular construction that may be altered to vary quantity of said extruded substance when wrapped.

10. The apparatus as defined in claim 9 wherein said supporting structure includes track means for mounting said first roller means, second roller means, third roller means and substance cutter means thereon for said independent modular construction.

11. The apparatus as defined in claim 6 wherein said wrapping means includes plow means for receiving and folding opposite edges of said wrapping material to a vertical position, rotating cam means contiguous with wrapping arms and turned by said drive means for periodically moving said wrapping arms to fold said wrapping material from a vertical position against a top of said extruded substance.

12. The apparatus as defined in claim 11 wherein said wrapping means includes clutch means for moving said wrapping arms from being contiguous with said cam means to prevent folding by said wrapping arms.

13. The apparatus as defined in claim 6 comprising fourth roller means mounted on said supporting structure for receiving said shingled sheets and extruded substance thereon from said third roller means, said fourth roller means being operated by said drive means to move said shingled sheets and said extruded substance through said substance cutter means to said conveyor means.

14. The apparatus as defined in claim 13 wherein said drive means includes means for turning said first, second, third and fourth roller means and said conveyor means so that said second roller means moves said wrapping material therethrough faster than said first roller means; said third roller means moves said wrapping material therethrough slower than said first roller means; said fourth roller means moving wrapping material therethrough at approximately the same speed as said third roller means but slower than said wrapping material and said extruded substance will move along said conveyor means.

15. The apparatus as defined in claim 6 wherein said dispensing means includes a rotatable frame means for receiving a plurality of rolls of wrapping material thereon, means for rotating said frame means while continually feeding a first of said rolls to said first roller means, means for locking said frame means into position, clamp means for retaining and retarding rotational movement of said rolls, said first roller means including means for cutting said wrapping material into said sheets.

16. In a machine for receiving and packaging an extrudable substance comprising the following components:

means for dispensing a wrapping material, first means for cutting said wrapping material into sheets of a predetermined size, means for overlapping leading and trailing edges of said sheets, means for moving said overlapped sheets and continuously receiving said extrudable substance along said overlapped sheets, second means for cutting said extrudable substance at least at points of said overlapping of said sheets, means for separating said sheets with said extrudable substance thereon at said points of cutting at said overlapping, means for wrapping said sheets around said extrudable substance to form a package, and means for conveying said package to container means;

said components being of a modular construction to vary size of said package by altering said components.

17. The machine as given in claim 6 comprising a control means receiving a control signal indicating flow of said extrudable substance onto said overlapped sheets; said control means using said control signal to time said first cutting means, said overlapping means, said moving and receiving means, said second cutting means, said separating means, and said wrapping means.

18. The machine as given in claim 7 comprising track means for said modular construction; successively mounted on and moveable with respect to said track means include at least said first cutting means, said overlapping means, said moving and overlapping means, said second cutting means and said separating means.

19. The machine as given in claim 8 comprising clutch means mounted on said track means adjacent said wrapping means, said clutch means interrupting operation of said wrapping means.

20. The machine as given in claim 16 wherein said second cutting means includes a plurality of blades with means for maintaining said blades perpendicular to said extrudable substance, said blades being pivotally mounted towards an outer edge of rotatable wheel means, said rotatable wheel means turning to periodically lower said blades to cut said extrudable substances.

21. The machine as given in claim 16 wherein said dispensing means includes a rotatable frame means positioned adjacent to said first cutting means, said rotatable frame means being adapted to receive a plurality of rolls of said wrapping material, a first of said rolls being fed to said first cutting means and simultaneously moved by said rotatable frame to a new position immediately prior to dispensing the entire first roll, subsequently a second of said rolls being started with continuous dispensing of said first roll, thereafter said first roll being replaced and said sequence repeated for said second roll.

22. The machine as given in claim 16 wherein said means for overlapping includes rotatable finger means for lifting said trailing edges of said sheets for insertion of said leading edges therebelow.

* * * * *